US012064799B2

(12) United States Patent
Martinis et al.

(10) Patent No.: US 12,064,799 B2
(45) Date of Patent: Aug. 20, 2024

(54) METHOD AND APPARATUS FOR PRODUCING FLAT METAL PRODUCTS

(71) Applicant: DANIELI & C. OFFICINE MECCANICHE S.P.A., Buttrio (IT)

(72) Inventors: Stefano Martinis, Udine (IT); Paolo Bobig, San Canzian d'isonzo (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 98 days.

(21) Appl. No.: 17/791,761

(22) PCT Filed: Dec. 4, 2020

(86) PCT No.: PCT/IT2020/050302

§ 371 (c)(1),
(2) Date: Jul. 8, 2022

(87) PCT Pub. No.: WO2021/140531

PCT Pub. Date: Jul. 15, 2021

(65) Prior Publication Data

US 2023/0042075 A1 Feb. 9, 2023

(30) Foreign Application Priority Data

Jan. 10, 2020 (IT) ..... 102020000000316

(51) Int. Cl.
*B21B 37/20* (2006.01)
*B21B 1/46* (2006.01)
(Continued)

(52) U.S. Cl.
CPC ..... *B21B 37/26* (2013.01); *B21B 1/463* (2013.01); *B21B 1/466* (2013.01); *B21B 13/18* (2013.01);
(Continued)

(58) Field of Classification Search
CPC ..... B21B 37/26; B21B 37/46; B21B 37/58; B21B 1/463; B21B 1/466; B21B 37/18;
(Continued)

(56) References Cited

U.S. PATENT DOCUMENTS 3,852,983 A * 12/1974 Cook ..... B21B 37/26 72/11.8
5,404,738 A * 4/1995 Sekiguchi ..... B21B 37/50 72/11.4
(Continued)

FOREIGN PATENT DOCUMENTS

EP 2346625 A2 7/2011
JP S61273210 A 12/1986
(Continued)

OTHER PUBLICATIONS

Int'l Search Report and Written Opinion issued Mar. 16, 2021 in Int'l Application No. PCT/IT2020/050302.

*Primary Examiner* — Debra M Sullivan
(74) *Attorney, Agent, or Firm* — Panitch Schwarze Belisario & Nadel LLP

(57) ABSTRACT

Method for the production of flat metal products, in particular coils of strip, in endless and/or semi-endless mode, in which a metal product is continuously fed to a rolling mill consisting overall of at least 4 stands. The rolling stands are, in sequence, roughing stands, and finishing stands. It is provided to perform a flying gauge change of the metal product exiting from the rolling mill.

12 Claims, 9 Drawing Sheets

(51) Int. Cl.

| | |
|---|---|
| ***B21B 13/18*** | (2006.01) |
| ***B21B 13/22*** | (2006.01) |
| ***B21B 15/00*** | (2006.01) |
| ***B21B 37/26*** | (2006.01) |
| ***B21B 37/46*** | (2006.01) |
| ***B21B 37/50*** | (2006.01) |
| ***B21B 37/58*** | (2006.01) |
| ***B21B 39/08*** | (2006.01) |

(52) U.S. Cl.
CPC ..... *B21B 13/22* (2013.01); *B21B 15/0007* (2013.01); *B21B 37/20* (2013.01); *B21B 37/46* (2013.01); *B21B 37/50* (2013.01); *B21B 37/58* (2013.01); *B21B 39/084* (2013.01); *B21B 2015/0014* (2013.01); *B21B 2015/0057* (2013.01); *B21B 2261/04* (2013.01); *B21B 2265/06* (2013.01); *B21B 2265/12* (2013.01); *B21B 2271/02* (2013.01); *B21B 2275/04* (2013.01)

(58) Field of Classification Search
CPC ..... B21B 37/20; B21B 37/50; B21B 15/0007; B21B 39/084; B21B 15/0014; B21B 2261/04
USPC ..... 72/240
See application file for complete search history.

(56) References Cited

U.S. PATENT DOCUMENTS

| | | | | |
|---|---|---|---|---|
| 2011/0272116 | A1* | 11/2011 | Benedetti | B21B 1/46 164/424 |
| 2011/0289993 | A1* | 12/2011 | Gruss | B21B 37/26 72/7.1 |

FOREIGN PATENT DOCUMENTS

| | | | |
|---|---|---|---|
| JP | H01202305 | A | 8/1989 |
| JP | 2004255421 | A | 9/2004 |
| WO | 2010049280 | A2 | 5/2010 |

* cited by examiner

| | Stand | Rolling roller speed | Strip Thickness | Reduction | Force applied to the rolling rollers | Bending force for a chock | Shifting | Inter-stand drawing action |
|---|---|---|---|---|---|---|---|---|
| | # | mps | mm | % | kN | kN | mm | Mpa |
| Subsequent set-up | | | | | | | | |
| | F1 | 2,15 | 8,47 | 50% | 22954 | 982 | 5 | 8,6 |
| | F2 | 3,72 | 4,95 | 42% | 27500 | 1000 | -5 | 10,6 |
| | F3 | 5,64 | 3,305 | 33% | 15025 | 900 | 5 | 12 |
| | F4 | 7,14 | 2,676 | 19% | 9717 | 517 | -5 | 13,3 |
| | F5 | 8,33 | 2,325 | 13% | 6247 | 350 | 5 | |
| Current set-up | | | | | | | | |
| | F1 | 1,9 | 8,995 | 47% | 20952 | 1228 | 5 | 5,9 |
| | F2 | 2,93 | 5,961 | 34% | 26218 | 1650 | -5 | 6,8 |
| | F3 | 4,08 | 4,329 | 27% | 13995 | 1000 | 5 | 9,1 |
| | F4 | 5,12 | 3,501 | 19% | 10697 | 575 | -5 | 9,7 |
| | F5 | 5,99 | 3,033 | 13% | 8844 | 350 | 5 | |

fig. 7

METHOD AND APPARATUS FOR PRODUCING FLAT METAL PRODUCTS

CROSS-REFERENCE TO RELATED APPLICATIONS

This application is a Section 371 of International Application No. PCT/IT2020/050302, filed Dec. 4, 2020, which was published in the English language on Jul. 15, 2021, under International Publication No. WO 2021/140531 A1, which claims priority under 35 U.S.C. § 119(b) to Italian Application No. 102020000000316, filed Jan. 10, 2020, the disclosures of each of which are incorporated herein by reference.

FIELD OF THE INVENTION

The present invention concerns a method and an apparatus for production of flat metal products, in particular to obtain coils of strip.

In particular, the present invention concerns the modes for changing the final thickness of the metal strip produced, advantageously, but not only, in endless and/or semi-endless mode.

BACKGROUND OF THE INVENTION

Apparatuses are known for the hot production of strip starting from the continuous casting of thin slabs. An apparatus for the production of strip can operate in a number of modes, separately or also simultaneously, that is to say in endless, semi-endless and coil-to-coil mode.

We will now summarize, for the sake of clarity, the characteristics of the three modes as above.

Endless: the process occurs in a continuous manner between the casting machine and the rolling mill. The cast slab feeds the rolling mill directly and without interruption. The material, when the apparatus is fully operational, is simultaneously engaged in all the machines, from the exit of the mold upstream as far as the winding reel/s downstream. Therefore, coils are produced without solution of continuity. The individual coils are formed by the cutting of a high speed shear in front of the winding reels. There is only one entrance to the rolling mill at the start of the process.

Semi-endless: the process occurs in a discontinuous manner between the casting machine and the rolling mill. A super-slab, equivalent to "n" (for example from 2 to 5) normal slabs, where by normal we mean the quantity of product needed to form a single coil, is formed at exit from the casting by the cutting of pendulum shear. From the corresponding super-slab "n" coils at a time are produced during rolling. The individual coils are formed by the cutting of the high speed shear in front of the winding reels. For each sequence of "n" coils produced, there is one entrance into the rolling mill.

Coil to coil: the process occurs in a discontinuous manner between the casting machine and the rolling mill. The individual slab is formed at exit from the casting machine by the cutting of the pendulum shear. One coil at a time is produced during rolling from the corresponding starting slab. For each coil produced, there is one entrance into the rolling mill.

The rolling mill used can have a number of stands normally ranging from 4 to 12. In an intermediate position along the rolling mill it is known, for example from EP 2.569.104, to provide a rapid heating system which, at least in endless mode, determines a restoration of the temperature of the product being rolled, before the last rolling passes are performed.

The position of the rapid heating system can determine, by convention, the subdivision of the rolling mill into roughing stands, upstream of the heating system, and into finishing stands, downstream thereof.

The rolling mill can therefore be represented in its subdivision, for example 2+4, 2+5, 3+5, in relation to the roughing stands which are the first stands of the rolling mill and perform the first thickness reduction of the product at entry, and to the finishing stands, which complete the thickness reduction up to the final value.

It is known that during the execution of a rolling process it can be necessary to modify the thickness of the final strip produced as a function of the production plan. This thickness change, at least in the endless and/or semi-endless modes, can be carried out without interrupting the rolling process, that is, while the material is passing through the rolling stands, and is known as Flying Gauge Change (hereafter FGC for short). The flying gauge change can occur by modifying the gap between the work rollers of the stands in a progressive manner, for example from upstream toward downstream, until all the stands have been adapted in their functioning parameters for the production of the new final thickness. In relation to the modification of the gap, the coordinated variation of the rotation speed of the rollers of each stand, or of part of the stands, and of the position of the tensioners, or loopers, located between the stands can also be provided.

Based on the difference between the final thickness and the initial thickness, the thickness variation can affect all stands or only a part of them.

The state of the art proposes EP 1.010.478, which describes a method for the flying gauge change in a tandem cold rolling mill using measurements of the thickness of the product at the exit of a stand (stand "i") in order to adjust the gap in the subsequent stand "i+1", and adjusting the rolling speed in the stand "i" itself in order to keep the mass-flow (thickness×speed) of the product being rolled constant from the head portion of the material to the entrance of the stand "i+1".

Furthermore, EP 2.346.625 is known in which, in order to carry out the flying gauge change (FGC) in a continuous rolling mill in endless mode, it is provided that the transition from the first exit thickness to the second exit thickness occurs at a feeding speed of the metal product into the first stand of the rolling mill which is adjusted as a function of the exit speed of the metal product from the casting machine disposed upstream of the rolling mill in the direction of the flow.

With the evolution of endless rolling processes, it has been verified that the processes of flying gauge change (FGC) during rolling can be improved in terms of reliability and quality of the product.

In particular, the management of the variations of mass-flow downstream (as set forth in EP 2.346.625) requires that the synchronization between the casting process and the rolling process be managed by the rolling speed as a function of the casting speed; consequently, every minimum mass-flow variation of the casting process has repercussions on the rolling process, generating a speed perturbation that overlaps those due to the flying gauge change (FGC). The presence of a possible heating furnace between the casting machine and the rolling mill introduces another potential disturbing element in the synchronization between the casting machine and the rolling mill, due to the temperature transients in the slab inside the furnace and to the elasticity of the slab itself.

Therefore, one purpose of the invention is to provide a method, and the corresponding apparatus, for producing flat metal products that makes the flying gauge change (FGC) of the strip produced more efficient in terms of reliability, stability of the process, easier management of the stands, less wear, better quality of the final strip obtained, and more.

The Applicant has devised, tested and embodied the present invention to overcome the shortcomings of the state of the art and to obtain these and other purposes and advantages.

SUMMARY OF THE INVENTION

The present invention is set forth and characterized in the independent claims. The dependent claims describe other characteristics of the invention or variants to the main inventive idea.

According to the present invention, it is provided to feed, in an apparatus for producing flat metal products, a metal product to a rolling mill consisting of at least 4 stands, advantageously 8 or more.

In particular, the apparatus provides to cast thin slabs with thicknesses comprised between 60 and 140 mm, and is intended for the production of final strip thicknesses from 0.7 mm to 20 mm, in one of the following three operating modes:

a) endless, for final thicknesses of the strip from 0.7 mm to 6.0 mm;
b) "semi-endless", for final thicknesses of the strip from 0.7 mm to 6.0 mm;
c) "coil-to-coil", for final thicknesses of the strip from 1.2 mm to 20 mm.

Advantageously, the control system of the apparatus allows to pass automatically from one mode to the other using the most convenient on each occasion.

The choice to operate according to one of the three modes indicated above is made:

- in relation to the quality of steel to be produced (for example Low Carbon Steel, Medium Carbon Steel, HSLA, Dual Phase, API Grades);
- to obtain different classes of final thicknesses of the strip, optimizing the production process;
- to optimize speed, rolling temperatures and corresponding energy consumption;
- to adapt the casting speeds to the available production of liquid steel so as to not interrupt the casting sequences.

It is therefore possible to select the most appropriate operating mode on each occasion, optimizing the energy saving, yield and use factor of the plant for each mode.

The apparatus therefore exploits all the prerogatives of an endless mode (possibility of producing ultra-thin thicknesses, and energy savings) maintaining its advantages while at the same time overcoming its limitations, thus being able to be defined as "universal endless mode".

Advantageously, the endless mode is used for all the qualities of steel that can be cast at high speeds, generally higher than 4.5 m/min.

To obtain the above, the apparatus essentially comprises five main elements, disposed with respect to each other in the sequence indicated below:

- continuous casting machine;
- tunnel furnace for possible heating and maintenance/equalization;
- roughing mill, comprising from 1 to 4 rolling stands;
- rapid heating unit with elements able to be selectively activated and removed from the line;
- finishing mill comprising from 3 to 7 stands;
- loopers, or tensioners, installed in all the inter-stands, from the first roughing stand to the last finishing stand, advantageously driven by hydraulic actuators to keep the tension between two successive stands constant, and to control the mass-flow.

According to a characteristic aspect of the apparatus, the tunnel furnace for possible heating and maintenance, located between the continuous casting machine and the roughing mill, has a length such that it contains a multiple length of slab to carry out the semi-endless rolling from which it is possible to obtain from 2 to 5 coils.

Thanks to these sizes of the tunnel furnace, the apparatus can be easily converted from "endless" mode into "semi-endless" or "coil-to-coil" mode, in particular when it is necessary to produce the qualities of steel that cannot be produced in endless mode since they need to be cast at low casting speeds.

Therefore, the tunnel furnace allows to disengage the casting machine from the rolling mill when the quality of the cast steel obliges to reduce the casting speed to values that render the endless process impracticable.

Furthermore, the potential of the tunnel furnace to accommodate slabs of multiple length up to 5 coils allows to guarantee an accumulation store with which possible stoppages in the rolling process can be managed in coil-to-coil mode, without particular repercussions on the casting process, which can thus continue to function for a certain time. In this way, the productivity of the meltshop that feeds the continuous casting machine is optimized.

The temperature of the slab exiting from the tunnel furnace is comprised between about 1050° C. and about 1150° C. in coil-to-coil and semi-endless modes, and between about 1150° C. and 1180° C. in endless mode, as a function of the quality of the steel and the final thickness of the strip.

As mentioned above, the length of the tunnel furnace also determines the buffer time obtainable in the coil-to-coil mode during the programmed roll change and/or during the unforeseen stoppages of the rolling mill due to cobbles or little incidents.

The buffer-time allows to increase the use factor of the plant and allows to improve the yield of the plant, since the number of casting re-starts is eliminated, or at least reduced, with a consequent saving of scraps at start and end of the casting process, and avoids to scrap the steel that, at the moment of the incident, is in the tundish at the beginning of the rolling mill, as well as that remaining in the ladle which often cannot be recovered.

The terminal part of the tunnel furnace provides a module (the last or the penultimate) that is transversely mobile in order to discharge the slabs laterally in emergency. This module, or shuttle, also allows to connect a possible second casting line, parallel to the first.

The rapid heating unit consists of an inductor with modular C-shaped elements which can be extracted individually (automatically or manually) from the rolling line when their use is not required.

The rapid heating unit is always used in the endless mode and can also be used in semi-endless mode.

It is configured in its heating and sizing parameters so that the strip, in endless and/or semi-endless modes, exits the last rolling stand of the finishing mill with a temperature no lower than 830-850° C.

The heating power delivered by the inductor unit is automatically controlled by a control unit in which a calculus program takes into account the temperatures detected along the rolling mill, the rolling speeds provided, the thickness of the finished profile and therefore of the temperature losses expected.

In this way, the heating is optimized and a rolling is obtained with a homogeneous temperature right from the first coil.

The invention further provides that it is possible to perform a flying gauge change (FGC) of the metal product exiting from the rolling mill during the rolling process.

In particular, the FGC is used during endless and/or semi-endless rolling to change the thickness of the coil subsequent to one that has already been completed, or even in the same coil. According to the thickness difference required, the thickness change can affect the finishing stands, or only part of them.

The roughing stands are affected by the thickness change only when is required the thickness change of the product at exit from the roughing stands (transfer bar) and which is fed to the finishing stands.

According to the invention, the first stand of the rolling mill, that is, the one that the material being fed, for example from the continuous casting, meets first, acts as the master stand and is not affected in any of its parameters whatsoever by the process of thickness change of the strip. In particular, the rotation speed of the rollers of the first stand and their gap are not modified.

The advantages that derive from not modifying the work parameters of the first rolling stand are as follows.

The power of the first rolling stand is much greater than the sum of powers of the motors of the rollers of the extractor machine located downstream of the casting machine; this makes it more advantageous, in terms of the effectiveness of the adjustment in the synchronization between casting speed and speed of the rolling mill in endless mode, to use the first rolling stand in master mode (set speed) and use the casting extractor machine in slave mode (adjusted speed).

For this reason, the invention provides to use the first rolling stand as the main actuator that dictates the speed of the entire casting and rolling line.

The speed of the material entering a rolling stand is set by the rotation speed of the rolling rollers and by the position of the so-called neutral angle in the mill bite. While the first quantity (speed of the rollers) can be controlled independently of the rolling process in progress (endless and/or semi-endless), the second quantity (neutral angle position) depends on the type of rolling process in progress (force/reduction).

In the case of endless rolling process in accordance with the present invention, a variation in thickness (difference between entry thickness and thickness at exit from the rolling stand) produces a variation in the speed at entry into the stand which propagates toward the casting machine.

In order to prevent generating a disturbance in the casting process, with negative consequences on the quality of the product, the invention provides a fixed reduction, and therefore not modifiable even during the FGC process, on the first rolling stand.

Therefore, by combining the use of the first rolling stand as speed master during endless rolling with the operative practice of keeping the reduction in said first rolling stand constant, a separation of the mass flow perturbations due to the casting-rolling mill synchronization is advantageously obtained. These perturbations can be compensated upstream with respect to the mass flow perturbations due to the flying gauge change, which are instead compensated downstream.

With regards to the calculation of the rolling forces/torques, of the speed cones of the stands, of the inter-stand tension, of the stand deflection and of the strategies to define the correct set of the profile and flatness actuators, we refer to what is already known in literature, for example in the book "Steel Rolling Technology, theory and practice" by Vladimir B. Ginzburg.

According to one aspect of the invention, the main actuators used during the flying gauge change are the hydraulic compression actuators and the motors of the rolling stands, the inter-stand loopers and the actuators for controlling the profile and the flatness of the strip, that is, the shifting actuators and the bending (or counter-bending) actuators.

The work parameters of each individual rolling stand, hereafter referred to as set-ups for short, are set with these actuators, which include: rotation speed of the rollers or rolling rolls of the stand (or simply stand speed), distance between the rolling rollers (or gap) that defines the thickness of the strip at exit from the stand, rolling or compression force, bending (or counter-bending) force applied to the rolling rollers and their shifting to control the flatness and profile of the strip, tension of the strip between two contiguous stands.

For the purposes of the flying gauge change (FGC), the main work parameters that have to be set are essentially the following three: speed (of the rollers) of the stand, gap between the rolling rollers/rolls, inter-stand tension.

The number of stands involved in the flying gauge change (FGC) is defined on the basis of the difference in absolute value between current thickness and new final thickness in accordance with the capacities of the rolling stands (power, speed, torques) and of the process parameters (rolling temperature, profile/flatness and mechanical properties of the strip).

In order to guarantee a good profile/flatness is maintained even in the section of the strip involved in the flying gauge change (FGC), the distribution of the forces of the current set-up and of the new set-up have to respect a reference distribution with a margin of tolerance.

Let us assume that the final thickness of the strip is varied by means of the flying gauge change (FGC), and in particular that a reduction thereof is carried out.

Maintaining constant the thickness of the bar (transfer bar) at exit from the roughing stands, that is, entering the first rolling stand of the finishing mill, the overall rolling force (that is, the sum of the individual rolling forces on all the finishing stands) has to be increased.

If this increase in force can be taken on by only the last finishing stands, for example the last two, remaining within an acceptable tolerance, then the flying gauge change (FGC) can only be applied on these two stands.

If this increase in force cannot be taken on by only the last two stands, because for at least one of them the force would fall outside the acceptable tolerance, then the flying gauge change (FGC) will have to be applied on a greater number of stands, potentially on the whole finishing mill, and possibly, if necessary, on the last stands of the roughing mill.

In this case, the new distribution of forces will follow a trend similar to the reference one, but with a value of the force slightly greater in each rolling stand compared to the previous rolling card.

It should be further noted that for each final thickness there is associated a corresponding range of thicknesses of the transfer bar, that is, of the product exiting the last roughing stand.

The thicknesses of the transfer bar are a finite number calculated so that a set of final thicknesses with the following characteristics corresponds to each transfer bar:

- all final thicknesses have to be able to be rolled with the same number of finishing stands;
- the thickness of the transfer bar has to be obtainable from the thickness of the slab in accordance with the capacities of the roughing stands and the process constraints (rolling temperature, profile/flatness of the transfer bar, mechanical properties of the transfer bar).

In some solutions of the invention, the flying gauge change (FGC) can occur in two modes.

A first embodiment, according to the present invention, to carry out flying gauge change (FGC) provides to carry out the final thickness change in two steps. This two-step mode has the advantage of minimizing the out of thickness segment of the strip, and is mainly used when at least two stands are used for the flying gauge change (FGC).

In particular, the application of the new set-up of the gap between the rollers, speed of the stand and inter-stand tension to the rolling stands involved in the thickness change occurs in the following manner:

- a first step in which the new target thickness and also the new speed cone, that is, the rotation speed reference for the work rollers of the rolling stands, are applied, and
- a second step in which a new inter-stand tension is applied by means of loopers or tensioners.

More in detail, when the section of strip affected by the thickness change reaches a specific stand (nth stand), the gap of that stand is modified from the current gap to a new gap calculated to produce the subsequent thickness with the current inter-stand tension. The rotation speed of the rolling rollers is simultaneously increased, or decreased, as a function of the new thickness in order to maintain the mass-flow (thickness×speed) constant.

The stands upstream and the casting are not involved in any set-up change.

The inter-stand tension, between the stand ($n^{th}$) and the stand ($n+1^{th}$) is modified only when the section of strip involved in the thickness change reaches the subsequent stand ($n+1^{th}$).

Simultaneously with the change of the inter-stand tension, the gap and the speed of the $n^{th}$ stand are further adjusted as a function of the new inter-stand tension value completing the transition to the new set-up for the $n^{th}$ stand.

With regards to the new set-up concerning the flatness and the profile of the strip (with bending and shifting actuators), this is applied the moment the section of strip involved in the thickness change reaches the $n^{th}$ stand.

This two-step FGC mode is then applied to all the subsequent stands as soon as the section of strip involved in the thickness change reaches each of said stands.

The rolling mill control system provides a tracking function which is tasked with updating in real time the exact position of the section/sections of strip involved in the thickness change along the entire rolling mill.

All the variations from the current to the new set-up are ramped, the inclination of the ramp is calculated with respect to the dynamic performances of the actuators used: the slowest actuator defines the dynamic of the change.

A second embodiment according to the present invention, in order to carry out the flying gauge change (FGC), provides to carry out the final thickness change with the stands simultaneously. This simultaneous mode has the advantage of making the adjustment of the rolling stands easier, and consequently is advantageous in terms of reliability.

This mode is advantageously applied when at least two stands are involved in the flying gauge change (FGC).

The transition from the current thickness to the subsequent thickness occurs by applying the new set-up simultaneously to all the stands involved in the thickness change.

If the stands involved in the flying gauge change (FGC) are more than two, the set-up variation can be advantageously applied in sequence in the first stands and simultaneously in the last two or more stands. This occurs in order to reduce the length of the transition segment of the strip from the current thickness to the new thickness, and at the same time maintain a good stability of the rolling process.

In detail, considering the new set-up, the following parameters are applied simultaneously to all the stands involved: rotation speed, gap or rolling force, inter-stand tension, flatness and profile.

In the simultaneous mode, the inter-stand tension adjusters (loopers or tensioners) perform the function of maintaining the correct mass-flow during the transition phase from the current thickness to the new thickness. The inter-stand tension adjusters act on the speed of the stand downstream. Furthermore, the speed of the first stand involved in the flying gauge change (FGC) is adjusted by adjusting the inter-stand tension of the stand upstream.

The adjuster of the gap between the rollers of the first stand involved in the flying gauge change (FGC) in simultaneous mode is kept in position control. The adjuster of the gap between the rollers of all the other stands downstream involved in the flying gauge change is switched from position control to force control before applying the new set-up.

In the simultaneous mode, the purpose of switching to force control is to allow the new reduction set-up to be applied for each stand starting from the force expected for the new exit thickness without knowing precisely the thickness at entry.

As soon as the end of transition segment of the strip reaches the gap between the rollers of a stand, the adjuster of the gap between rollers is switched to position control in order to guarantee the correct thickness of the strip at exit from each stand.

The application of the new set-up of parameters is coordinated by a specific tracking function.

In the simultaneous mode, all the variations from the current to the new set-up are ramped, the inclination of the ramp is calculated with respect to the dynamic performances of the actuators used, the slowest actuator defines the dynamic of the change.

As mentioned, in some situations in which just the use of the finishing stands for the thickness change is not sufficient, some of the roughing stands may also be involved, in particular one or more of the stands downstream of the first roughing stand.

Also in this case, according to the invention, the speed of the first roughing stand is not modified. In order to decide how many roughing stands, starting from the last one, have to be involved in the flying gauge change, the same criterion described above for the finishing stands can be used, that is, evaluate how many roughing stands have to take on the thickness change, based on the maximum acceptable compression force.

As mentioned, the speed at which the material is fed, in this case the casting speed, remains constant, as is the case for all the work parameters of the first roughing stand.

BRIEF DESCRIPTION OF THE DRAWINGS

These and other characteristics of the present invention will become apparent from the following description of some embodiments, given as a non-restrictive example with reference to the attached drawings wherein:

FIG. 7 shows a table relating to an example of parameter changes in the passage from one thickness to another;

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

We will now refer in detail to the various embodiments of the present invention, of which one or more examples are shown in the attached drawings. Each example is supplied by way of illustration of the invention and shall not be understood as a limitation thereof. For example, the characteristics shown or described insomuch as they are part of one embodiment can be adopted on, or in association with, other embodiments to produce another embodiment. It is understood that the present invention shall include all such modifications and variants.

Figure 1:
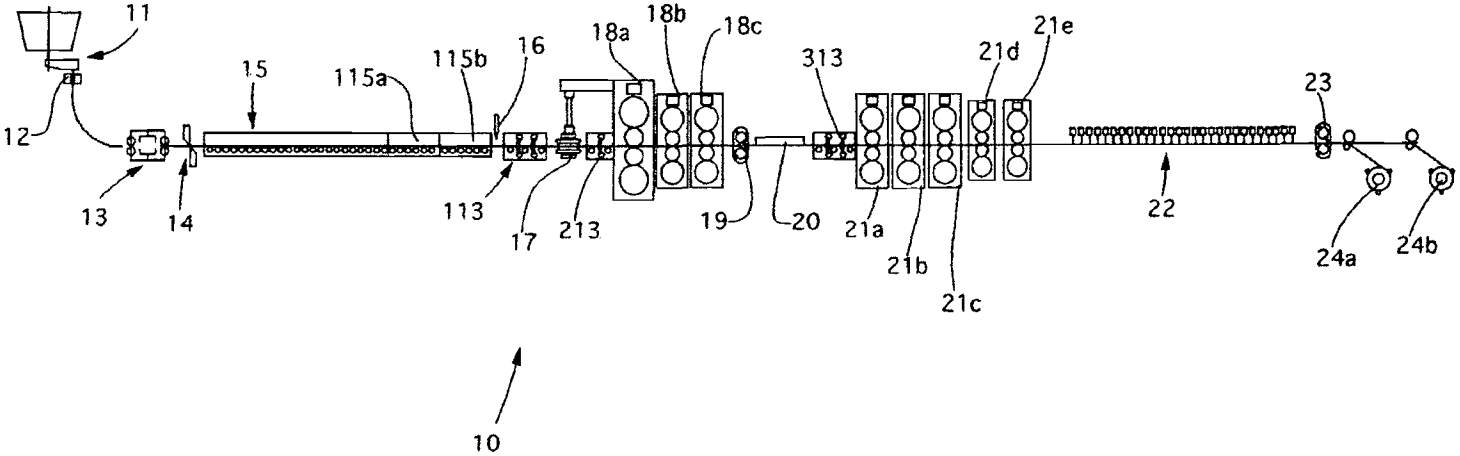
FIG. 1 schematically shows an example of an apparatus for producing flat metal products in accordance with some characteristics of the present invention.

FIG. 1 shows, as a whole, and schematically, an example of an apparatus 10 for the production of flat metal products in which the flying gauge change method described hereafter in detail can be applied. It is understood that the representation of FIG. 1 is only an example to facilitate the understanding of the invention, which is completely non-binding for the application of the concepts presented below.

It is also understood that not all the components shown are necessary and essential for the correct functioning of the apparatus.

For example, the apparatus 10 comprises a control system suitable to receive the instructions relating to the cards relating to a determinate casting process, as well as relating to determinate flying gauge changes of the final product to be made, and to adjust the work parameters of all the rolling stands as a result of the flying gauge change as above.

In general, the apparatus 10 comprises, as constituent elements:

- a continuous casting machine 11 having an ingot mold 12;
- a possible first descaling device 13;
- a pendulum shear 14;
- a tunnel furnace 15, which can have at least one laterally mobile end module 115*a*-115*b*,
- an oxyacetylene cutting device 16;
- a possible second descaling device 113;
- a possible vertical or edge-trimmer stand 17;
- a third descaling device 213;
- three roughing rolling stands 18*a*, 18*b*, 18*c;*
- a crop shear 19 to crop the head and tail ends of the bars in order to facilitate their entrance into the first stand of the finishing mill; it can also be used in the event of an emergency shearing in the event of blockages in the finishing mill in endless mode;
- a modular induction rapid heating device 20;
- an intensive cooling system (not shown) located downstream of the rapid heating device to be used in case there is a need to carry out a thermomechanical rolling process or a ferritic field rolling process in the finishing mill;
- a fourth descaling device 313;
- a finishing rolling mill, comprising in this case five stands, respectively 21*a*, 21*b*, 21*c*, 21*d* and 21*e;*
- laminar cooling showers 22;
- a high-speed flying shear 23 to shear the strip to size, to divide the strip into coils of the desired weight, when it is directly engaged with the winding reels; and
- a pair of winding reels, respectively first 24*a* and second 24*b*.

The casting and rolling process carried out by the apparatus 10 can occur in endless, semi-endless and coil-to-coil modes.

FIGS. 2-6 represent graphs which represent, by varying the specific parameters indicated, modes for the flying change of the final thickness of the strip of the type applicable in the apparatus 10 described above, in particular in the endless and/or semi-endless modes indicated above.

Figure 2:
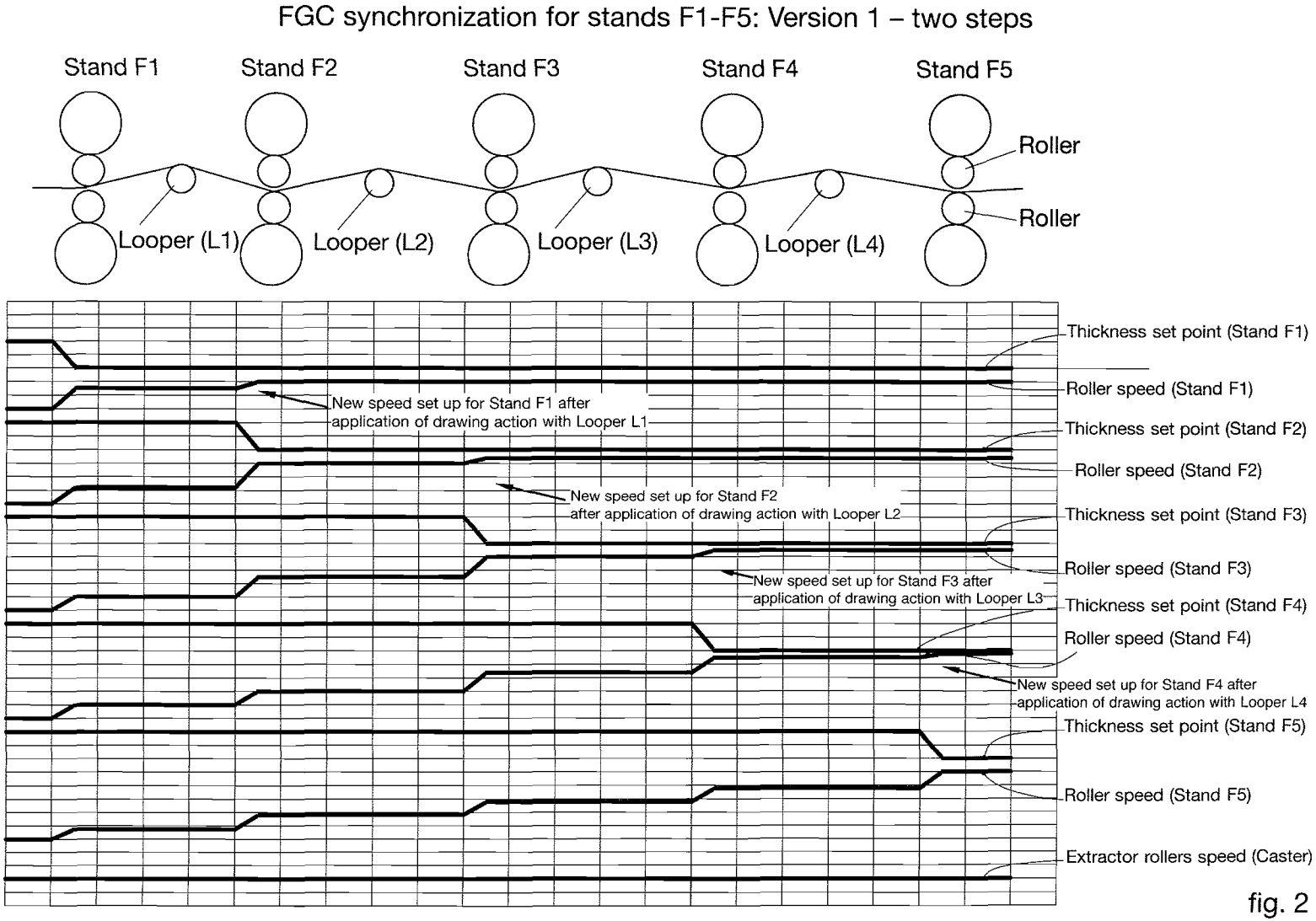
FIGS. 2-6 schematically represent graphs of embodiments of the flying gauge change method applicable in the method for producing flat metal products in accordance with some characteristics of the present invention.

In a first embodiment, shown in FIG. 2, only the finishing stands 21*a*-21*e*, indicated as F1-F5, are involved in the thickness change that occurs in the two-step mode.

As can be seen from the graphs, observing the lines traced from top to bottom, when it is necessary to modify on the fly the final thickness of a strip being rolled, a set-point of the new thickness is identified in the first finishing stand F1. In this case, the new thickness is smaller than the previous thickness (thickness reduction).

In the first step, the new gap between the rolling rollers, corresponding to the new thickness, of the first finishing stand F1 is set, and the speed of the rollers of the same stand F1 is increased simultaneously until it reaches the new set-point. The second step provides the application of the new set of inter-stand tension, in this case the tension of the strip is increased.

All the successive stands F2-F5 progressively adjust their speed both in relation to each speed change of the previous stand, and also in relation to the moment in which the final end of the transition segment reaches the stand itself. As can be seen in the trend of the last line, the speed at which the material is fed, in this case the casting speed, remains constant, as well as the speed of all the stands upstream of the stand F1, that is, of all the roughing stands.

Figure 3:
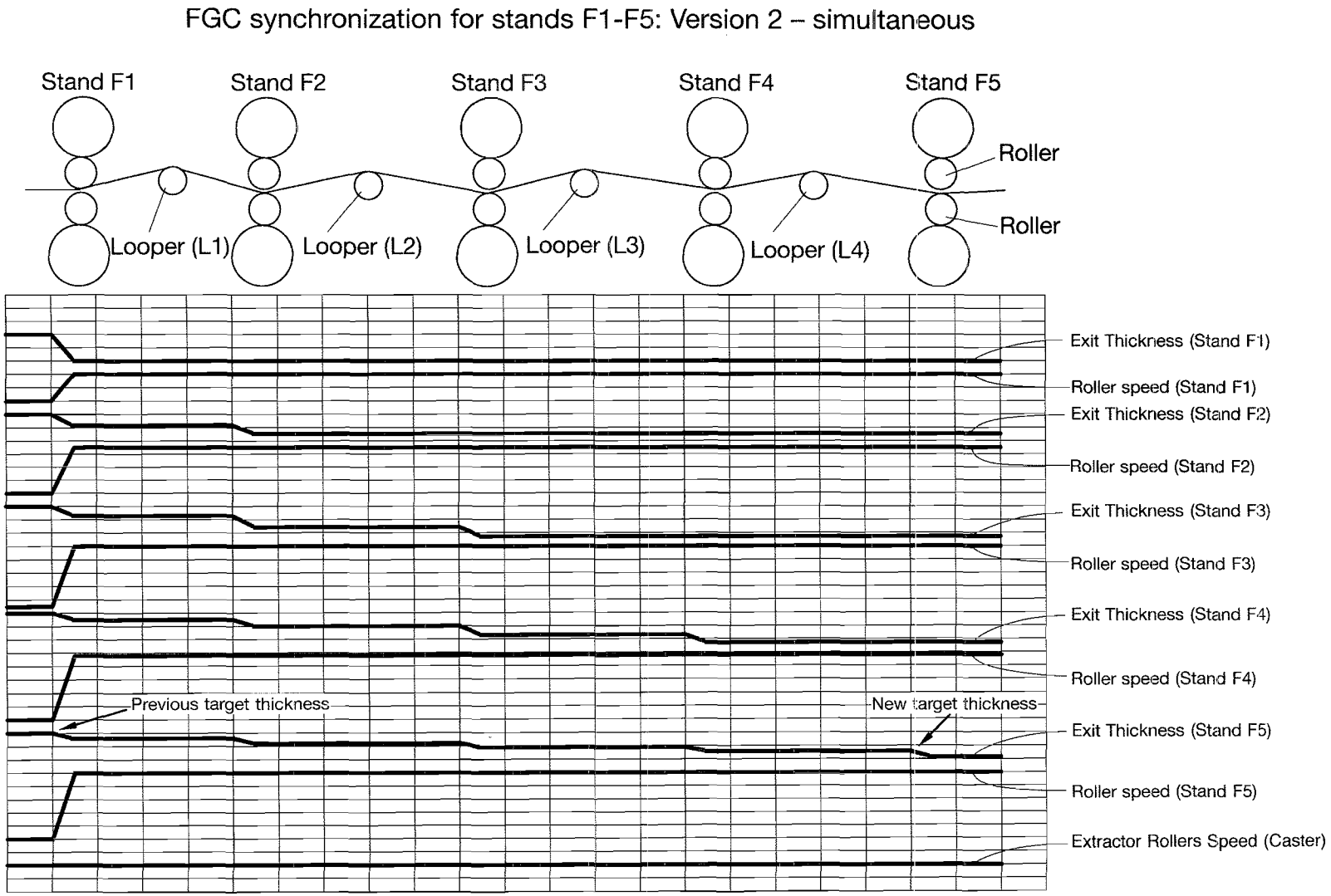

In a second embodiment, shown in FIG. 3, only the finishing stands 21*a*-21*e*, indicated as F1-F5, are involved in the thickness change which occurs, however, contrary to what observed previously, in simultaneous mode.

As can be observed, the adjustment of the speed of all the stands F1-F5 occurs in the same instant, while the thickness adapts sequentially, stand by stand, from the preceding value to the final target value.

The speed at which the material is fed, in this case the casting speed, remains constant, as well as the speed of all the stands upstream of the stand F1, that is, of all the roughing stands.

Figure 4:
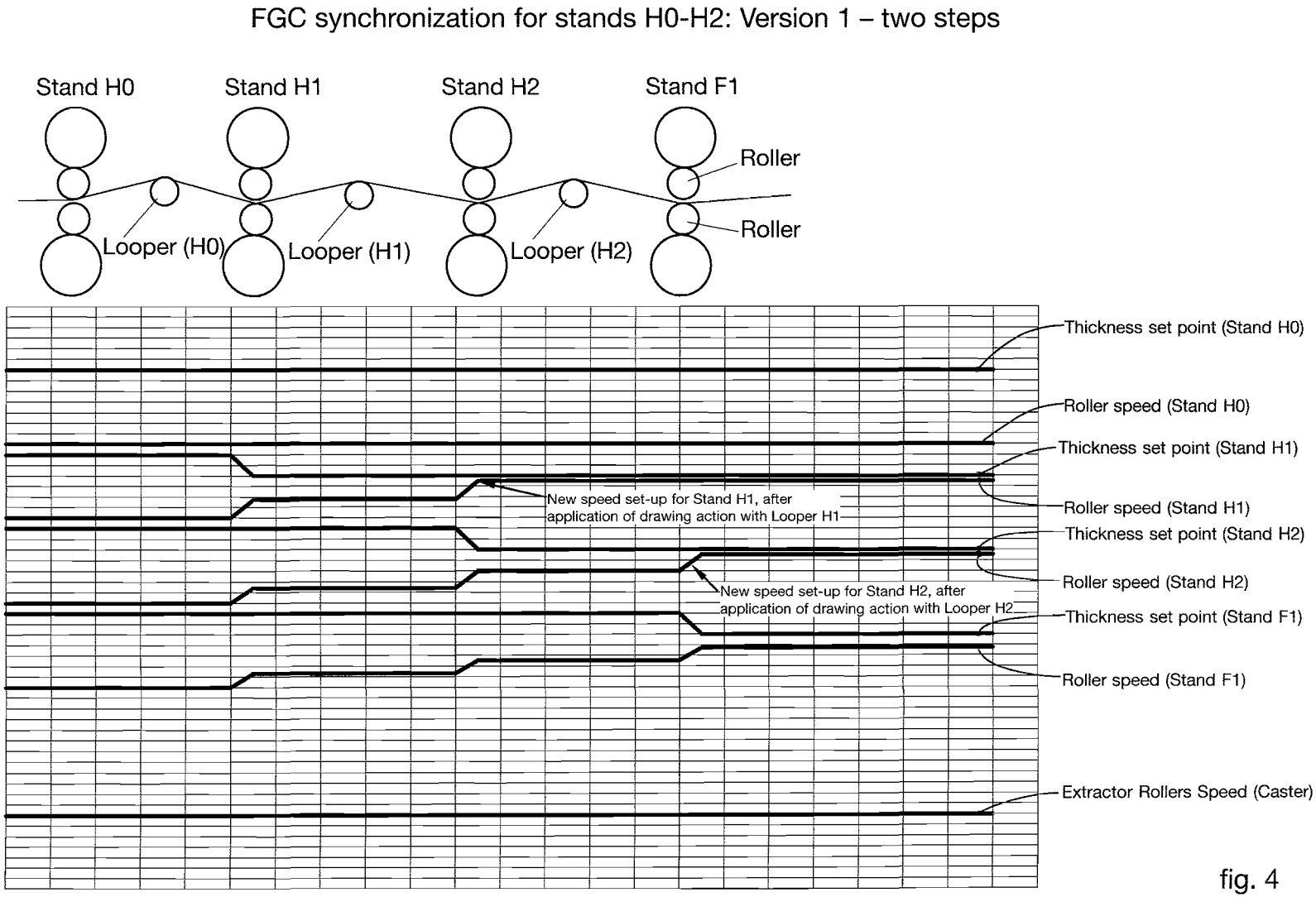

In another embodiment, shown in FIG. 4, some of the roughing stands are also involved, in this case the stands 18*b*, 18*c* downstream of the first stand 18*a*. The roughing stands 18*a*-18*c* are indicated in the graphs as H0-H2.

According to the invention, as can be observed, the speed of the first stand H0 is not modified, as is the case for the other work parameters of the same stand H0. The first stand involved in the thickness change is the (second) stand H1 and the rotation speed of the rolling rollers is adjusted in two steps. The same applies to the (third) stand H2.

The speed at which the material is fed, in this case the casting speed, remains constant, as does the speed of the first roughing stand H0.

Figure 5:
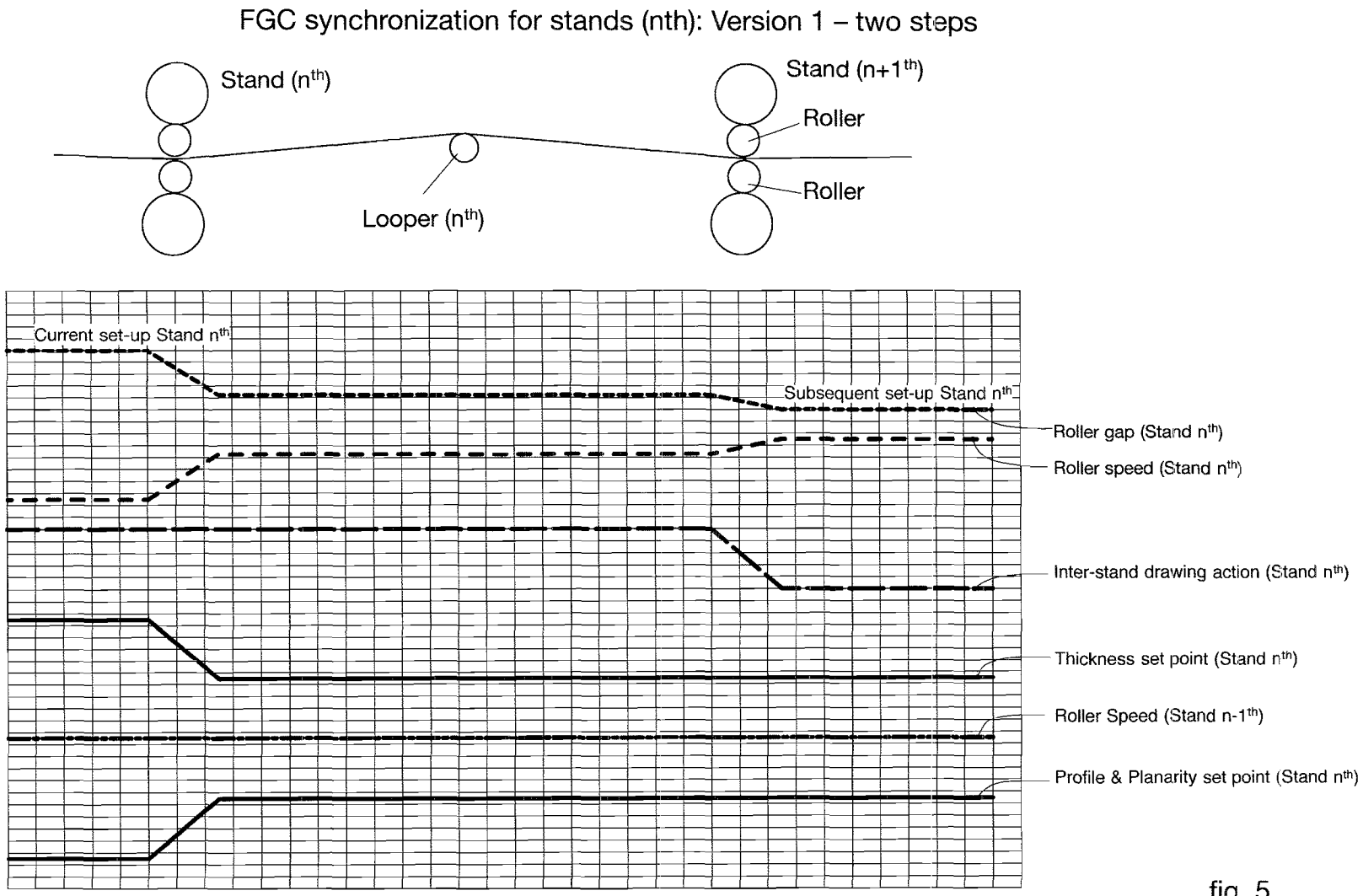

FIG. 5 shows, in greater detail, the first embodiment of the two-step thickness change for the single stand ($n^{th}$); in particular, it is possible to observe when the new inter-stand tension set-ups and the new profile and flatness set-ups are actuated.

Figure 6:
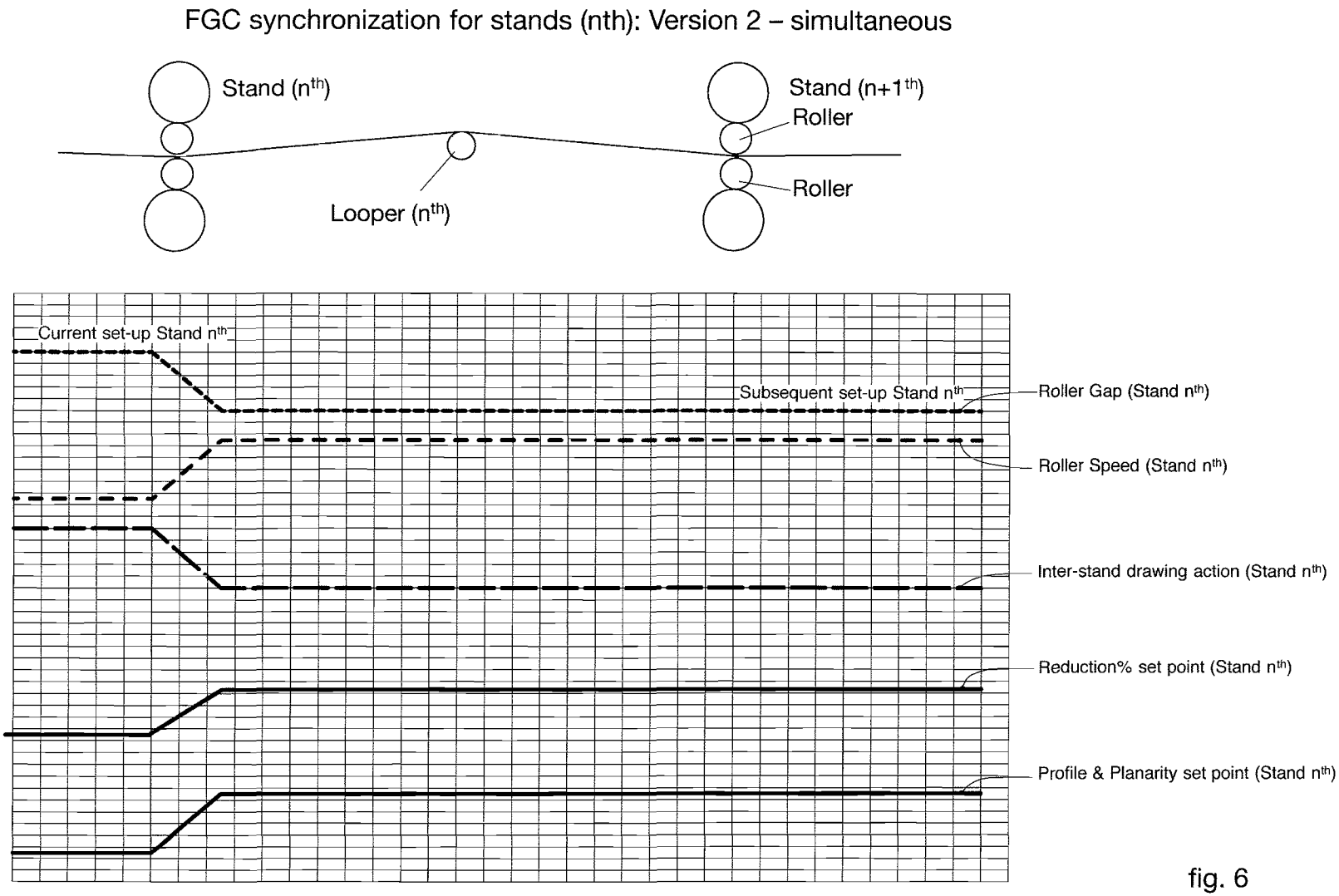

FIG. 6 shows, in greater detail, the second embodiment of the simultaneous thickness change for the single stand ($n^{th}$); in particular, it is possible to observe how all the set-ups are actuated simultaneously: the application of the new force set-up (in this case an increase of the compression/reduction, the penultimate line of the graph) entails the simultaneous application of the new gap set-up (that is, of thickness reduction); simultaneously, the set-ups for the inter-stand tension and for the profile and flatness actuators are also modified.

The new speed set-up is calculated starting from the previous set-up with the aim of keeping the mass-flow unchanged.

In particular, the formula for calculating the new set-up can thus be expressed:

subsequent roller speed=(current roller speed)* (thickness in stand ($n^{th}$)–subsequent)/(thickness in stand ($n^{th}$)–current).

FIG. 7 (Table 1) shows, by way of example only, an example of a variation of the set-up of parameters, from a current set-up to a subsequent set-up, in the event of a change from a final thickness of the strip of about 3 mm to a final thickness of the strip of about 2.3 mm.

As can be observed, in this case only the finishing stands F1-F5 are affected by the change of set-up of parameters. The reduction in the final thickness of the strip is accompanied by an increase in the speed of the rollers of the stands, as well as an increase in the compression force. The inter-stand tension also increases in relation to the thickness reduction to be obtained.

FIGS. 8 to 11 describe the modes in which another embodiment of the invention provides to calculate the number of stands involved in the flying gauge change (FGC). In particular, we take for example the case where it is not necessary to change the thickness of the transfer bar and the finishing mill comprises 5 finishing stands, with reference to the lay-out of FIG. 1.

Figure 8:
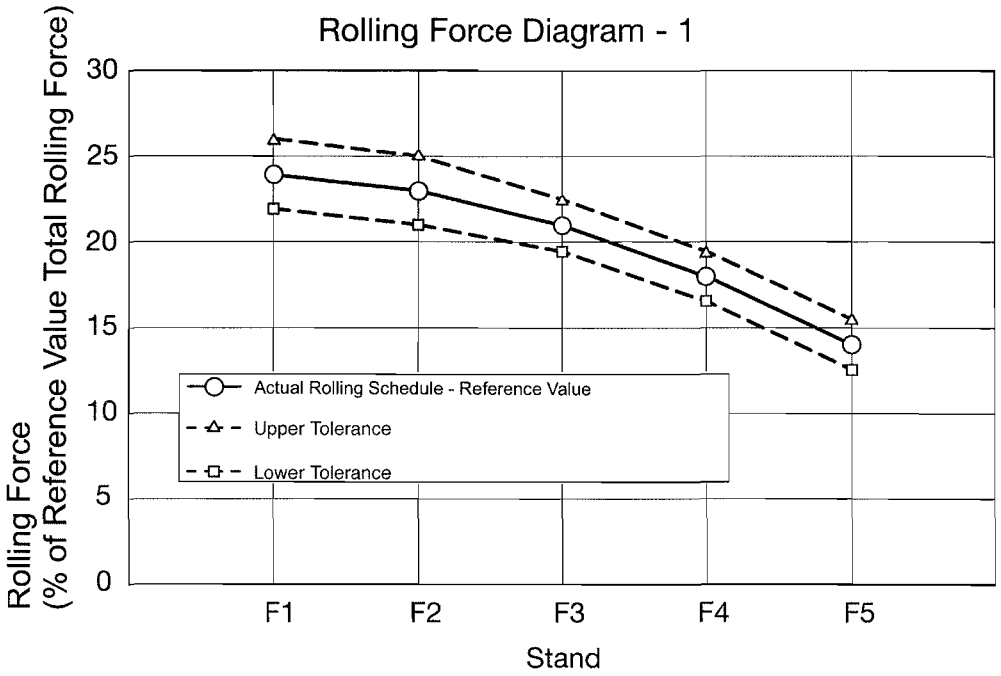
FIGS. 8-11 show example graphs of the criteria for identifying the stands involved in the thickness change.
Figure 9:
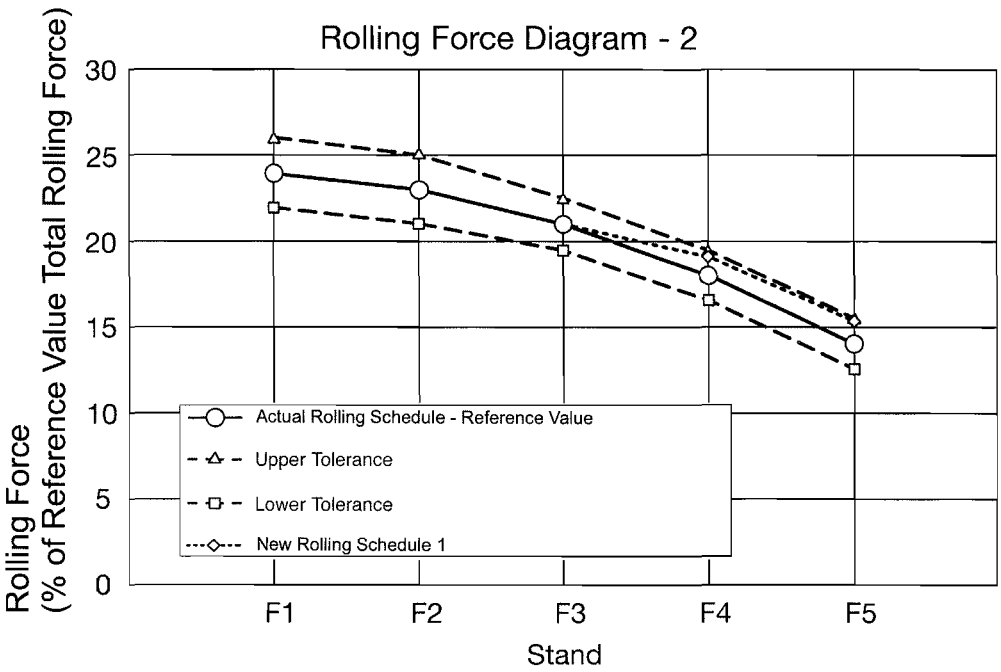

A typical distribution of the rolling force on the various stands is shown in FIG. 8.

The central continuous line represents the distribution of reference forces, while the two dashed lines above and below indicate the upper and lower tolerance range, within which the rolling force can vary without compromising the quality of the finished product. Let us assume that the final thickness of the strip is changed using FGC, and in particular that a reduction thereof is actuated.

Keeping constant the thickness of the bar (transfer bar) entering the first rolling stand of the finishing mill, the overall rolling force (that is, the sum of the individual rolling forces on the 5 stands) will have to increase. As can be observed in FIG. 9, the effective rolling force in the last two stands increases, but remains within the acceptable upper tolerance range. Consequently, the thickness change can be taken on by the last two stands of the finishing mill, without involving other stands upstream.

Figure 10:
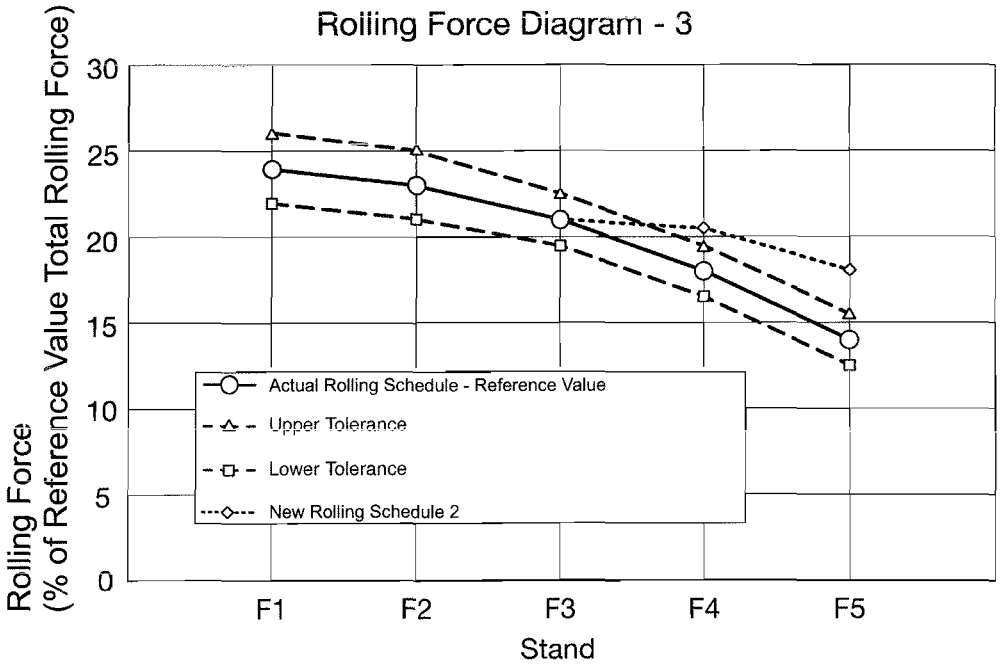

If, on the other hand, the new distribution of forces causes the rolling force in even just one of the stands to exit from the acceptable tolerance, as shown in FIG. 10, then the FGC cannot be taken on the last two stands alone, but at least one further stand upstream has to be involved.

Figure 11:
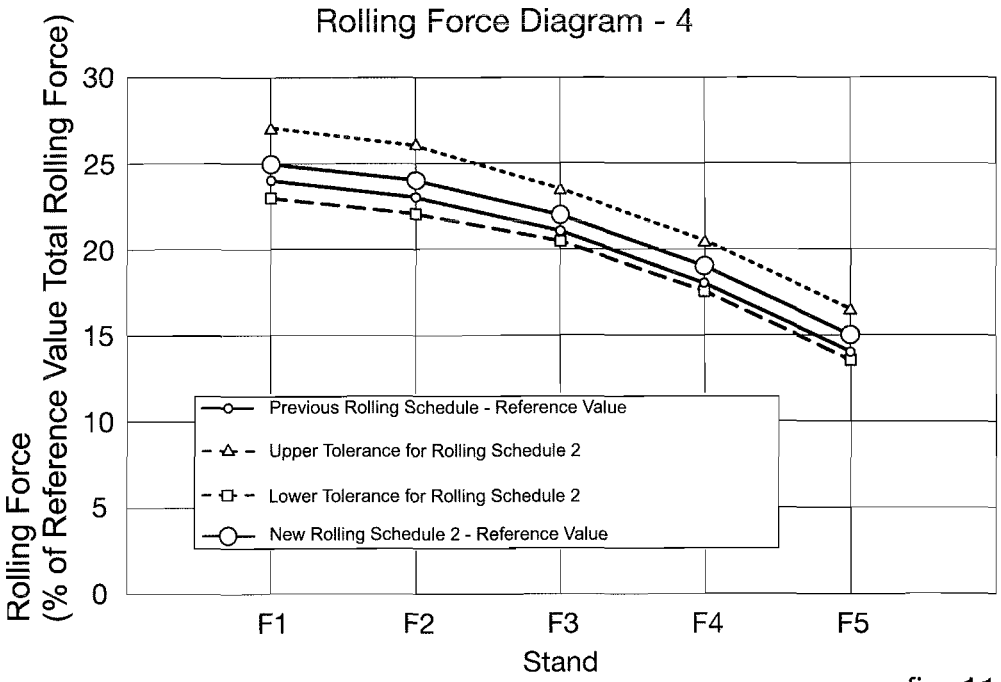

FIG. 11 shows how the new distribution of forces on the finishing mill leads to a trend similar to the initial one of FIG. 8, but with a greater force value in all the stands, that is, the curve of the forces in all 5 finishing stands has the same trend but with an increased value compared to the beginning.

It is clear that modifications and/or additions of parts may be made to the apparatus 10 and method for the production of strip as described heretofore, without departing from the field and scope of the present invention.

The invention claimed is:

1. A method for the production of flat metal products in endless and/or semi-endless mode, the method comprising:

continuously feeding a metal product to a rolling mill including at least first through fourth rolling stands, in which the rolling stands include roughing stands and subsequently finishing stands; and performing a flying gauge change of the metal product exiting from the rolling mill without interrupting the rolling process, without modifying a rotation speed of rollers of at least the first rolling stand and without modifying a gap between the rollers of at least the first rolling stand, during the flying gauge change of the metal product.

2. The method as in claim 1, wherein the flying gauge change is applied also without modifying the speed of material fed to the rolling mill.

3. The method as in claim 1, wherein performing the flying gauge change comprises employing a number of rolling stands starting from a last one of the finishing stands of the at least first through fourth rolling stands the number of rolling stands employed being calculated by taking into account a distribution of a rolling force of each stand of the at least first through fourth rolling stands, so that a new distribution of forces due to the thickness change does not cause the value of the rolling force of any stand of the at least first through fourth rolling stands required to perform the flying gauge change to exceed an acceptable tolerance range.

4. The method as in claim 3, wherein in the event the new distribution of rolling forces due to the flying change determines the exit from an acceptable tolerance range, then at least a new rolling stand located upstream of those already provided will be involved in the thickness change process.

5. The method of claim 1, wherein the flying gauge change comprises a change of thickness.

6. The method as in claim 5, wherein the change of thickness comprises applying a new set-up of parameters to transition from an initial thickness to a subsequent thickness.

7. The method of claim 6, wherein the new set-up of parameters includes the gap between rollers, the rotation speed of the rollers, and inter-stand tension, to all of the rolling stands involved in the flying gauge change.

8. The method as in claim 7, wherein the application of the new set-up of gap between the rollers, speed of the rollers and inter-stand tension to the rolling stands involved in the flying gauge change occurs in the following manner:

a first step in which the new target thickness and a new rotation speed reference for the rollers of the rolling stands, are applied, and a second step in which a new inter-stand tension is applied by means of loopers or tensioners.

9. The method as in claim 8, wherein when a section of the metal product affected by the thickness change reaches a specific stand ($n^{th}$ stand) of the at least first through fourth rolling stands, the gap of that specific stand is modified from the current gap to a new gap calculated to produce the subsequent thickness with an unmodified inter-stand tension, and the speed of that specific stand is increased, or decreased, as a function of the new thickness in order to maintain constant mass-flow (thickness×speed).

10. The method as in claim 9, wherein the inter-stand tension is modified when the section involved in the thickness change reaches a subsequent stand ($n+1^{th}$) of the at least first through fourth rolling stands and is engaged with both the specific stand ($n^{th}$ stand) and the subsequent stand ($n+1^{th}$), and the gap and the speed of the specific stand ($n^{th}$ stand) are adjusted along with the modification of the inter-stand tension, thereby completing the transition to the new set-up for the specific stand ($n^{th}$ stand).

11. The method as in claim 6, wherein the transition from the initial thickness to the subsequent thickness occurs by simultaneously applying a new set-up to at least one of the rolling stands other than the first rolling stand.

12. The method as in claim 6, wherein the new set-up of respective parameters are conducted in a progressively increasing or decreasing manner.

* * * * *